US006835908B2

(12) United States Patent
Bailey et al.

(10) Patent No.: US 6,835,908 B2
(45) Date of Patent: Dec. 28, 2004

(54) METHOD AND APPARATUS FOR ELECTROSPARK DEPOSITION

(75) Inventors: Jeffrey A. Bailey, Richland, WA (US); Roger N. Johnson, Richland, WA (US); Walter R. Park, Benton City, WA (US); John T. Munley, Benton City, WA (US)

(73) Assignee: Battelle Memorial Institute

( * ) Notice: Subject to any disclaimer, the term of this patent is extended or adjusted under 35 U.S.C. 154(b) by 0 days.

(21) Appl. No.: 10/742,706

(22) Filed: Dec. 19, 2003

(65) Prior Publication Data

US 2004/0182826 A1 Sep. 23, 2004

Related U.S. Application Data

(60) Provisional application No. 60/435,399, filed on Dec. 20, 2002.

(51) Int. Cl.[7] ..... B23K 9/04
(52) U.S. Cl. ..... 219/76.13
(58) Field of Search ..... 219/76.13; 427/540

(56) References Cited

U.S. PATENT DOCUMENTS 3,832,514 A * 8/1974 Antonov ..... 219/76.13
4,226,697 A * 10/1980 Antonov et al. ..... 219/76.13
4,556,775 A * 12/1985 Inoue ..... 219/76.13
4,866,237 A * 9/1989 Inoue ..... 219/76.13
5,448,035 A * 9/1995 Thutt et al. ..... 219/76.13

OTHER PUBLICATIONS

Roger N. Johnson, Eletro–Spark Deposited Coatings for High Temperature Wear and Corrosion Applications, 1995, p. 265–277.

* cited by examiner

*Primary Examiner*—Clifford C. Shaw
(74) *Attorney, Agent, or Firm*—Allan C. Tuan

(57) ABSTRACT

A method and apparatus for controlling electrospark deposition (ESD) comprises using electrical variable waveforms from the ESD process as a feedback parameter. The method comprises measuring a plurality of peak amplitudes from a series of electrical energy pulses delivered to an electrode tip. The maximum peak value from among the plurality of peak amplitudes correlates to the contact force between the electrode tip and a workpiece. The method further comprises comparing the maximum peak value to a set point to determine an offset and optimizing the contact force according to the value of the offset. The apparatus comprises an electrode tip connected to an electrical energy wave generator and an electrical signal sensor, which connects to a high-speed data acquisition card. An actuator provides relative motion between the electrode tip and a workpiece by receiving a feedback drive signal from a processor that is operably connected to the actuator and the high-speed data acquisition card.

54 Claims, 6 Drawing Sheets

METHOD AND APPARATUS FOR ELECTROSPARK DEPOSITION

CROSS-REFERENCE TO RELATED APPLICATIONS

This application claims the benefit of, and priority to, Provisional U.S. Patent Application No. 60/435,399 filed Dec. 20, 2002 and entitled "Electronic controls for electrospark deposition on non-line-of-sight surfaces," the entire contents of which are hereby incorporated herein by this reference.

STATEMENT REGARDING FEDERALLY SPONSORED RESEARCH OR DEVELOPMENT

This invention was made with Government support under Contract DE-AC0676RLO1830 awarded by the U.S. Department of Energy. The Government has certain rights in the invention.

FIELD OF INVENTION

The present invention generally relates to the field of coating technologies, and more particularly, to an electrospark deposition apparatus and a method of controlling same.

BACKGROUND

Electrospark deposition (ESD) is a pulsed-arc, microwelding process that uses short-duration, high-current electrical pulses to deposit a consumable electrode material on a conductive workpiece. ESD processes typically involve very high spark frequencies with spark durations lasting only a few microseconds, and usually require manual control or preprogramming of the process parameters. Significantly, depositions result in very little heat input because heat is generated during less than 1% of a weld cycle and dissipated during 99% of the cycle. ESD coatings are extremely dense and metallurgically bonded to the workpiece.

One of the distinguishing aspects of ESD, as compared to other arc-welding processes, is that the electrode contacts the surface rather than maintaining a stand-off distance to control the arc. Alternative deposition techniques for material repair and protection include high-velocity oxygen fuel (HVOF) thermal spray, physical vapor deposition (PVD), chemical vapor deposition (CVD), and electrolytic hard chrome (EHC) plating. In contrast to most of the above-mentioned techniques, which may produce mechanical or chemical bonds with a workpiece, ESD creates a true metallurgical bond while maintaining the workpiece at or near ambient temperatures.

One advantage of the ESD process is that the electrical pulse has a short duration, which produces nano-structured coatings with unique tribological and corrosion performance caused by the very rapid solidification of the deposited material. An additional benefit is that ESD does not call for special surface-preparation techniques, deposition chambers, spray booths, or particular operator protections for most materials. Perhaps most significantly, the process releases very little, if any, hazardous wastes, fumes, or effluents. The environmental compatibility of the ESD process is in sharp contrast to EHC plating, which the Department of Defense currently employs at virtually every repair depot.

EHC plating utilizes chromium in the hexavalent state (hex-Cr), which is a known carcinogen. Due to the hazards associated with hex-Cr, both the Environmental Protection Agency (EPA) and the Occupational Safety and Health Administration (OSHA) strictly regulate air emission and permissible exposure limits. Furthermore, the EPA continues to propose lower allowable discharge concentrations, thereby significantly reducing the cost-effectiveness of EHC. Thus, significant motivation exists to implement alternative coating technologies that may lead to total replacement of chromium plating activities.

Because of its many advantages, ESD represents a viable, alternative deposition technique for material repair and protection. However, there are a number of critical variables that must be controlled for the process to result in acceptable coatings. Nearly all of these variables can be set or controlled by a skilled operator using prior experience and observing the spark characteristics during deposition. Therefore, the process has been used most frequently on external metal surfaces where the operator has clear visibility of, and easy access to, the workpiece. In general, ESD processes have been limited to applications where an operator can observe the weld arcs. When attempting to control the arc in applications involving non-line-of-sight coating of difficult-to-access geometries, a means and method to monitor and control the spark characteristics in a way that compensates for the operator's lack of visibility must be developed and employed. Alternatively, the means and method could provide feedback that allows the operator to exercise the necessary process controls to maintain optimal spark characteristics. One of the primary and most troublesome variables that must be managed is the contact force between electrode tip and the workpiece. Too much or too little force renders the metallurgical structure of the final deposit unacceptable. Thus a need for an apparatus and a method for controlling ESD exists.

SUMMARY

In view of the foregoing and other problems, disadvantages, and drawbacks of traditional coating technologies and ESD, the present invention has been devised. The invention resides in a novel apparatus for ESD and a method of controlling same. In one embodiment, the method for controlling ESD comprises the steps of providing an electrode tip, a conductive workpiece, a contact force between the electrode tip and the conductive workpiece, and a series of electrical energy pulses to the electrode tip. The method further comprises measuring a plurality of peak amplitudes from the series of electrical energy pulses, determining the maximum peak value out of the plurality of peak amplitudes, and obtaining an offset by comparing the maximum peak value to a target value, which correlates with an optimum contact force. Finally, the contact force is optimized according to the value of the offset.

The apparatus for controlled ESD comprises a consumable electrode tip electrically connected to an electrical energy wave generator and an electrical signal sensor, which connects electrically to a high-speed data acquisition card. A workpiece mounting system exists that allows the workpiece to contact the electrode tip, while an actuator provides relative motion between the mounting system and the electrode tip. A processor electrically connected to the high-speed data acquisition card and the actuator receives a feedback signal, compares the feedback signal to a set point, and transmits a drive signal to the actuator.

It is an object of the invention to provide the necessary feedback for automated adjustment of selected process parameters, such as contact force, required for achieving the desired metallurgy and application-specific surface characteristics.

It is another object to reproducibly coat non-line-of-sight and difficult-to-access surfaces using ESD. An example of one such surface is the inner surface of a gun barrel.

Yet another object of the present invention is to provide an environmentally-friendly coating alternative to traditional technologies such as EHC plating, PVD, and HVOF thermal spraying.

Still another object of the invention is to provide a portable ESD apparatus whereby an operator controls the contact force in response to a sensory stimulus emitted by the portable apparatus.

An additional object is to provide an efficient method, based on a design of experiments package, for determining the set points that will result in an optimum metallurgical structure of a deposit for a particular electrode tip/conductive workpiece combination.

Another additional object is to provide a method of using ESD in combination with three-dimensional models for forming a desired surface contour on a workpiece.

DETAILED DESCRIPTION

The present invention is directed to controlled electrospark deposition. The ESD process employs electrical power in the form of a pulsed arc to deposit a coating Material. The electrode tip and the conductive workpiece may comprise metals, alloys, conductive ceramics, and cermets. The arcs comprise a series of extremely short pulses a few microseconds in duration. The pulses allow rapid solidification of the deposit and given the appropriate contact force, result in the high-quality, nano-structured coatings typical of ESD.

The contact force may potentially vary as a function of a significant number of process variables. For example, the usual measurement of a cyclic electrical variable is the root mean square (RMS), which is an averaged value. However, the RMS measurement of the electrical variables (voltage, current, power, etc.) in ESD failed to produce a consistent feedback value resulting in irregular electrode-tip-to-workpiece power delivery. The resolution of this problem lies in analysis of the electrical variable wave form, rather than the usual averaging function.

Figure 1:
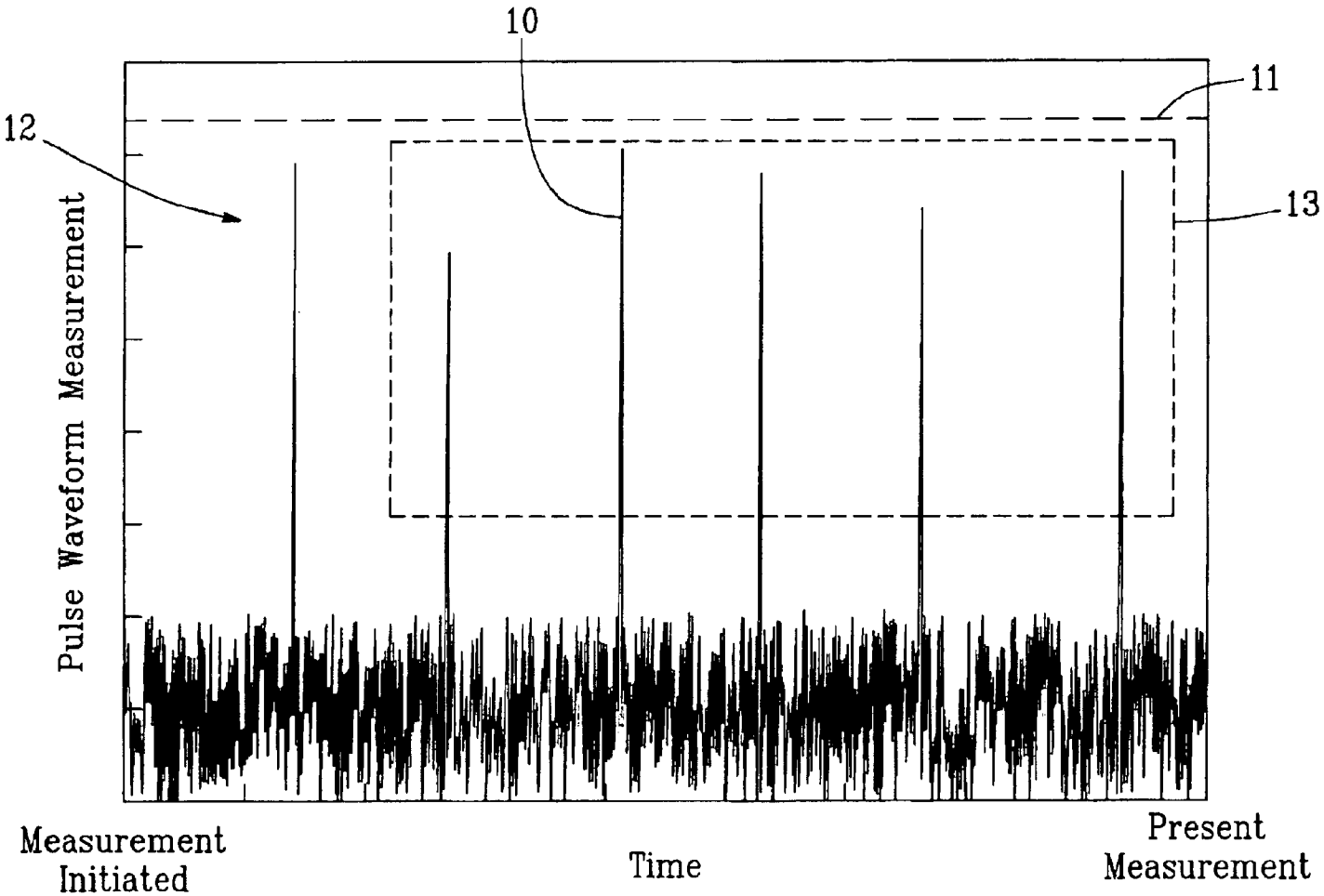
FIG. 1 is a plot showing a series of electrical energy pulses delivered through the electrode tip and acquired by the data acquisition card.
Figure 2:
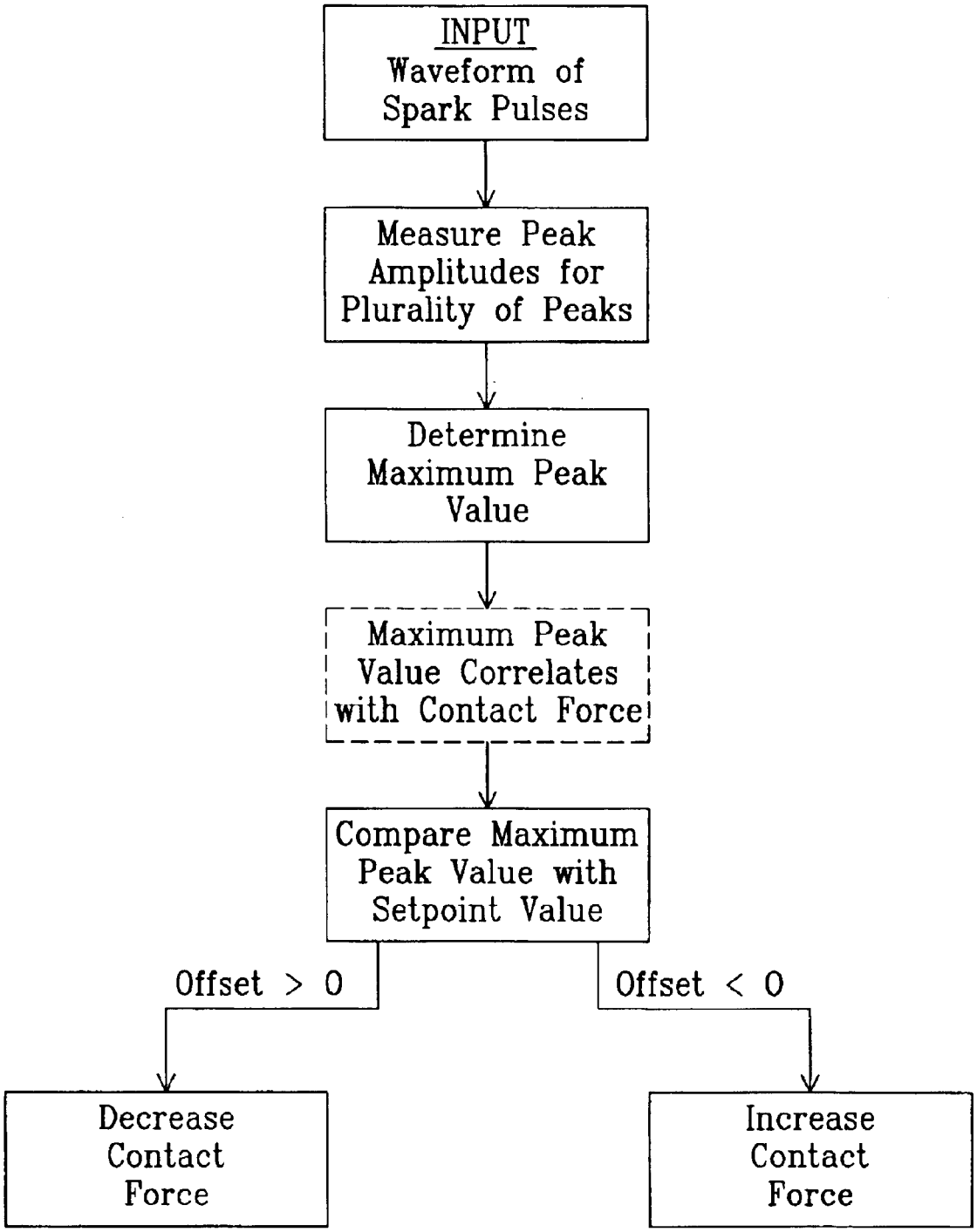
FIG. 2 is a flow diagram illustrating a version of the ESD control method.

Therefore, the present invention comprises using a high-speed, digital measurement technique to profile the electrical variable data stream, which gives a feedback response. The high-speed, digital measurement technique takes a significant number of very fast, very short measurements of the pulse waveform in a digital data sweep. When plotted, as shown in FIG. 1, this digital data sweep shows the real-time value of the electrical variable as it would be shown on an oscilloscope. The electrical variable data stream appears as a low amplitude sweep with short-duration, high-amplitude pulses 12. The technique then involves analyzing the digital data sweep to determine the highest single value for the pulses, also referred to as the maximum peak value 10, among a plurality of peaks 13. The maximum peak value 10 correlates with the contact force applied between the electrode tip and the conductive workpiece. When compared to a target value set point 11 representing the optimum contact force, the correlation allows the maximum peak amplitude 10 to be used as a feedback signal for controlling the contact force, thereby enabling automation of the ESD process and/or applicability in non-line-of-sight circumstances. A flowchart, shown in FIG. 2, illustrates and summarizes an embodiment of the control method described by the instant invention.

Figure 3:
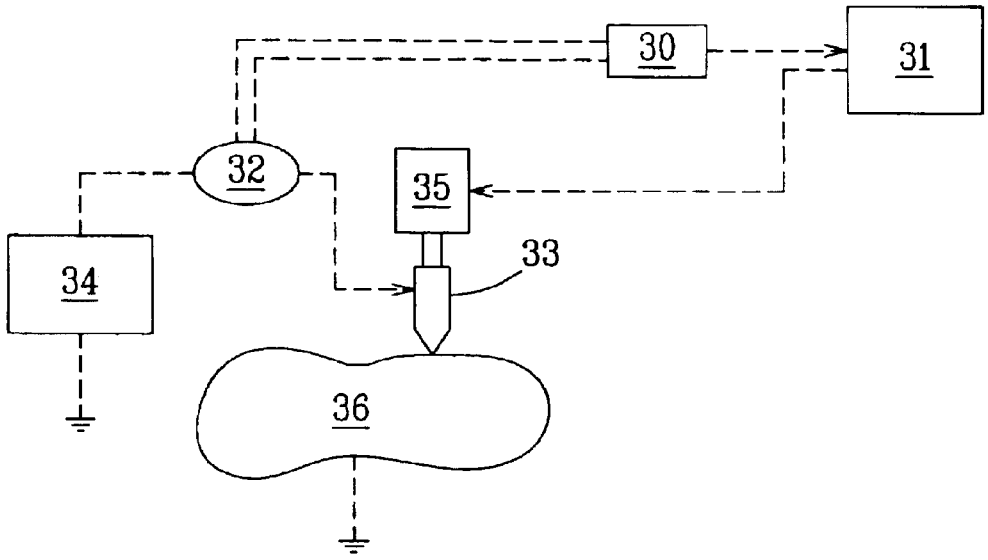
FIG. 3 is a system diagram showing an embodiment of the electrospark deposition apparatus.

Referring to FIG. 3, one may acquire the electrical variable data stream, also referred to as a series of electrical pulses, using a high-speed data acquisition (DAQ) card 30 such as the PCI-6115, 10 MHz multi-channel DAQ card manufactured by National Instruments. In one version of the controlled-ESD apparatus, the DAQ card 30 is electrically connected to a processor 31 and an electrical signal sensor 32. The sensor 32 may be an ammeter, a voltmeter, or another electrical-variable measuring device. In the present example, the sensor measures the electrical pulses delivered to an electrode tip 33 by the electrically-grounded power supply 34. The processor 31 delivers a feedback drive signal to an electrically-connected actuator 35, which mechanically attaches to the electrode tip 33, thereby enabling the processor 31 to control the contact force between the electrode tip 33 and the electrically-grounded workpiece 36 according to the method described earlier.

Figure 4A:
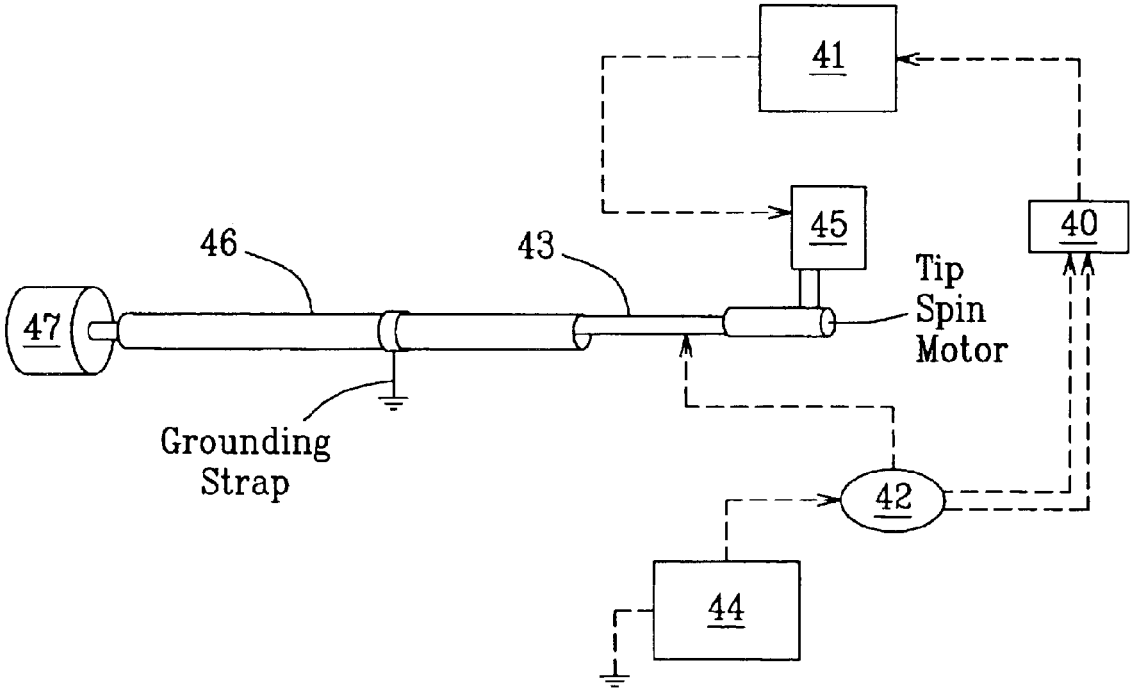
FIG. 4*a* is a system diagram showing a version of the ESD apparatus as applied to gun-barrel, inner-surface coating.
Figure 4B:
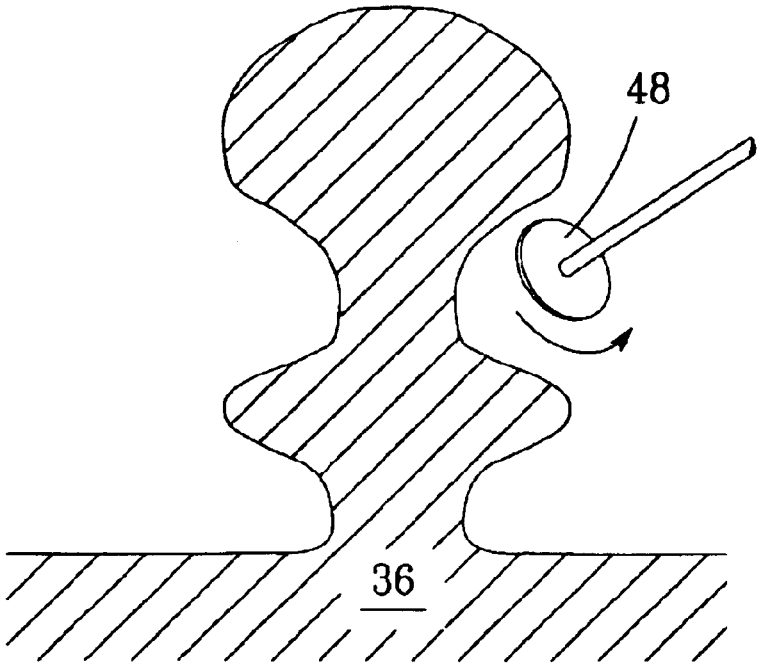
FIG. 4*b* is a diagram showing a non-axial version of the electrode tip in a spinning disc configuration.
Figure 4C:
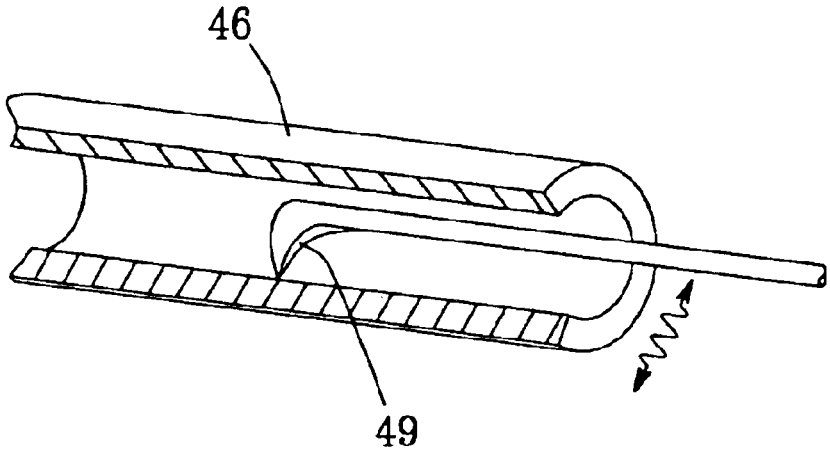
FIG. 4*c* is a diagram showing a non-axial version of the electrode tip in an oscillating, bent tip configuration.

In another version of the invention, shown in FIG. 4*a*, the electrode tip 43 is inserted into a gun barrel 46 to coat the inside surface of the barrel. A motor 47 rotates the gun barrel around its longitudinal axis. The remaining components including the processor 41, DAQ card 40, sensor 42, power supply 44, and actuator 45 connect in an analogous manner as the apparatus illustrated in FIG. 3. In order to facilitate deposition on surfaces that are difficult to access, such as the inside of gun barrels, the electrode tip may comprise non-axial configurations. In such configurations, the geometry of the tip may be conducive to applying the contact force in a non-parallel direction relative to the longitudinal axis of the electrode-tip shaft. One version of a non-axial electrode tip configuration is a spinning disk 48 attached to the electrode-tip shaft as shown in FIG. 4*b*. Another version, referring to FIG. 4*c*, is an oscillating, bent tip 49. Both embodiments of the non-axial electrode tip configuration present advantages for coating difficult-to-access surfaces of a workpiece.

Data acquisition must be sufficiently rapid to prevent aliasing, wherein the plotted data sweep misrepresents the true series of electrical pulses. In one embodiment, the high-speed data acquisition card acquires data at a rate greater than or equal to about one million times per second. In a preferred embodiment, data acquisition occurs about ten million times per second. Among others, the series of electrical pulses may comprise the current, the voltage, or the power delivered to the electrode tip. In a preferred embodiment, the short series of electrical pulses is the current.

The analysis of the digital data sweep may be performed by a processor that measures a plurality of peak amplitudes and determines the maximum peak value by comparing from among the plurality of peak amplitudes. In one version of the invention, the processor may be a computer. In another version, the processor may be a computer with a graphical development software environment such as LabView for signal acquisition, measurement analysis, and data presentation. In yet another version, the processor may be a programmable logic array. The number of peaks included in the plurality of peak amplitudes should be large enough to represent a statistically proper sampling for determining the maximum peak value, but not so large as to introduce a significant lag between the data being analyzed by the processor and the most recently acquired peak. In a preferred embodiment, the plurality of peak amplitudes comprises a sampling of the last five peak amplitude measurements.

Figure 5:
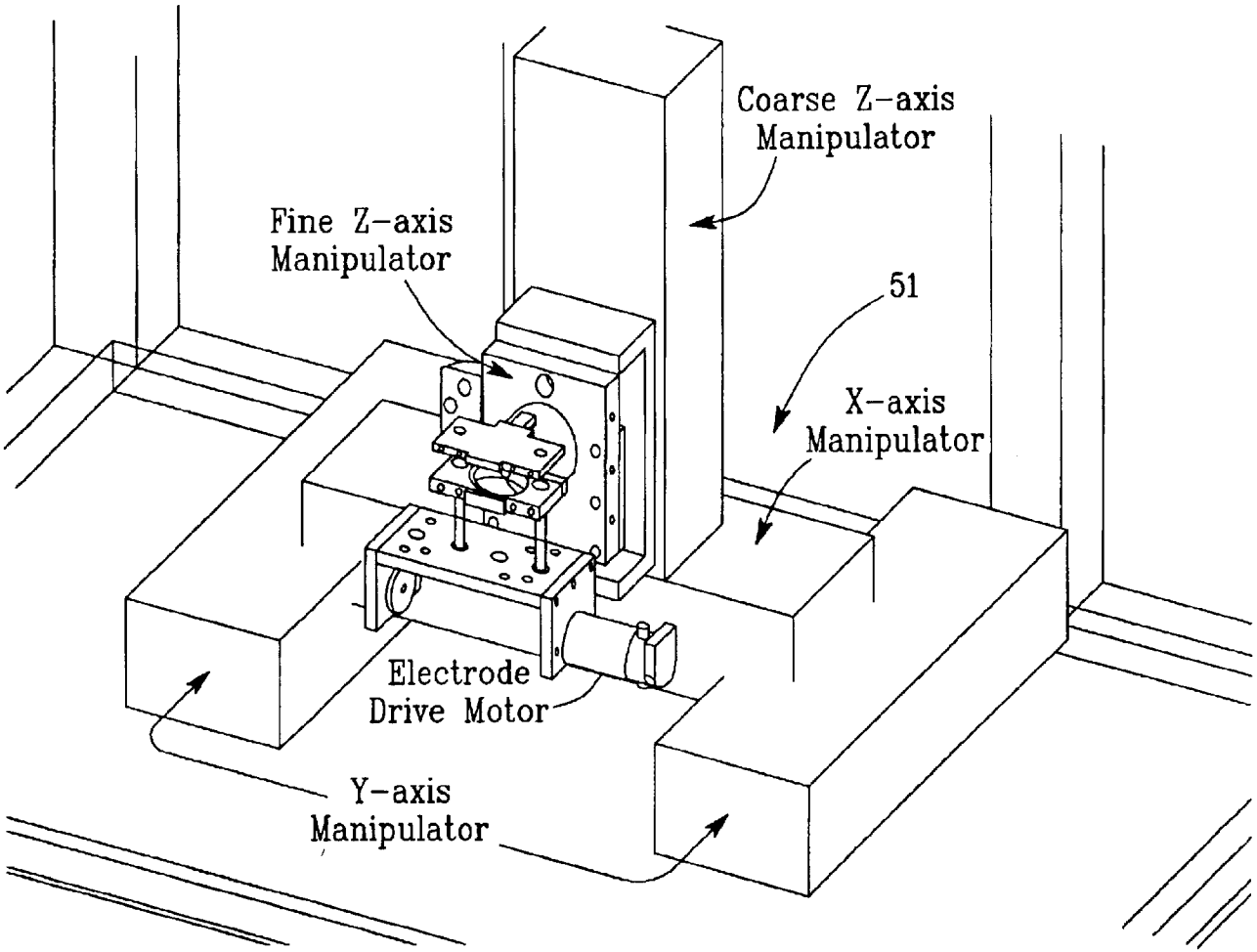
FIG. 5 is a schematic showing an embodiment of the actuator that provides relative motion between a workpiece and an electrode tip.

Once the processor identifies a maximum peak value, it compares the value to a target value set point representing the optimum contact force. The difference between the maximum peak value and the target value is also referred to as the offset. The processor the optimizes the contact force according to the value of the offset. In one version of the invention, the processor optimizes the contact force by sending a feedback drive signal to the actuator that adjusts the contact force. For example, if the offset were greater than zero, then the feedback drive signal would reduce the force applied by the actuator. If the offset were less than zero, then the feedback drive signal would increase the contact force applied by the actuator, which is free to move in at least one degree of motion. In a preferred embodiment, the actuator may provide three degrees of linear motion and three degrees of rotational motion between the electrode tip and the conductive workpiece. Referring to FIG. 5, another embodiment of the present invention may comprise an XYZ-translation stage 51 as the actuator.

In another embodiment, the adjustment and optimization of the contact force is dictated by a control scheme comprising proportional, proportional-integral, and proportional-integral-derivative control terms. In yet another embodiment, software-controlled electronic and mechanical components actuate the ESD process wherein the electronic and mechanical components comprise sensors, processors, data acquisition cards, actuators, power supplies, and/or wave generators.

Alternatively, in another version, the adjustment and optimization of the contact force is manually actuated by an operator responding to a sensory stimulus emitted according to the offset. The sensory stimulus may comprise an indicator designed to emit an audible tone, a visual display, and/or a tactile sensation. Referring to the manually-actuated version, the feedback drive signal from the processor may optionally drive the sensory-stimulus indicator according to the offset instead of the actuator. In such an instance, the sensory-stimulus indicator electrically connects to the processor in a manner analogous to the actuator. Thus, in one example, if the operator does not apply the appropriate contact force, as determined by the set point, the indicator would emit an audible tone. A relatively high pitch would indicate the application of too much pressure, while a low pitch tone would indicate the application of too little pressure. Upon hearing the emitted tone, the operator would compensate by increasing or decreasing the force being applied. The method of the present version may be embodied in a hand-held apparatus for ESD wherein rather than being attached to the mechanical actuator, the electrode tip is attached to a housing that allows the operator to safely and conveniently manipulate the electrode tip manually. The housing may comprise a handle.

In another embodiment, the process variable target values, including the contact force, may be easily predetermined and quickly optimized using a design of experiments (DOE) package such as a Taguchi Variable mathematics package. While the use of DOE packages is well-known, they have not been applied to ESD because of the lack of reproducibility given the many process variables one must attempt to control. However, the control method described by the instant invention allows one to reproducibly perform experiments in which one consistently sets a number of variables and alters the remaining parameters. This has previously been unachievable and is a novel ramification of the instant invention. The variables that may be analyzed in such a way include but are not limited to a) the electrode tip's composition, microstructure, geometry, rotation speed, scan speed, contact force, number of passes, and overlap of passes; b) the cover gas composition, flow rate, temperature, and flow geometry; c) the workpiece's composition, cleanliness, surface finish, temperature, and geometry; and d) the spark's energy, frequency, voltage, capacitance, inductance, duration, time per unit area, peak current, and rise time.

As described above, the existence of a process variable that correlates with the contact force and serves as a feedback control variable enables automation of the ESD process and expands the process' applicability to non-line-of-sight circumstances. For example, the process may be automatically executed in any orientation and independent of gravity because the processor-controlled actuator allows the contact force to be applied in any direction. The range of geometries that may be affected by the present invention includes the inner surface of a gun barrel, the inner surface of a valve body, contoured surfaces, conductive nuclear reactor and steam turbine components that are susceptible to wear and corrosion, surfaces on cutting instruments, the surface of hydraulic cylinders and pistons, and more.

A method for controlled ESD may further comprise rastering the electrode tip across the workpiece surface. The workpiece surface may have flaws requiring repair wherein the flaws comprise pits, grooves, cracks, worn sections, corroded sections, nicks, and/or chips. In one version of the invention, a workpiece may be built up to form a desired surface contour by repeatedly coating the workpiece until the desired contour is achieved. Furthermore, optical, magnetic, mechanical and/or other scanning systems can be used to survey and determine the state of the existing surface contour: After scanning, the existing surface contour may be represented by a three-dimensional model. The measured three-dimensional model can be compared to a desired surface contour, also referred to as the theoretical three-dimensional model, to determine the extent of deposition required to obtain the desired surface contour. In one embodiment, the coating of the workpiece and the scanning repeats iteratively until the measured three-dimensional model is substantially the same as the desired surface contour. Examples of optical scanning techniques include laser-surveying methods, and holography, while an example of a magnetic scanning technique is eddy current measurement and modeling. Mechanical methods also exist and include surface probe measurements and profilometry.

Figure 6:
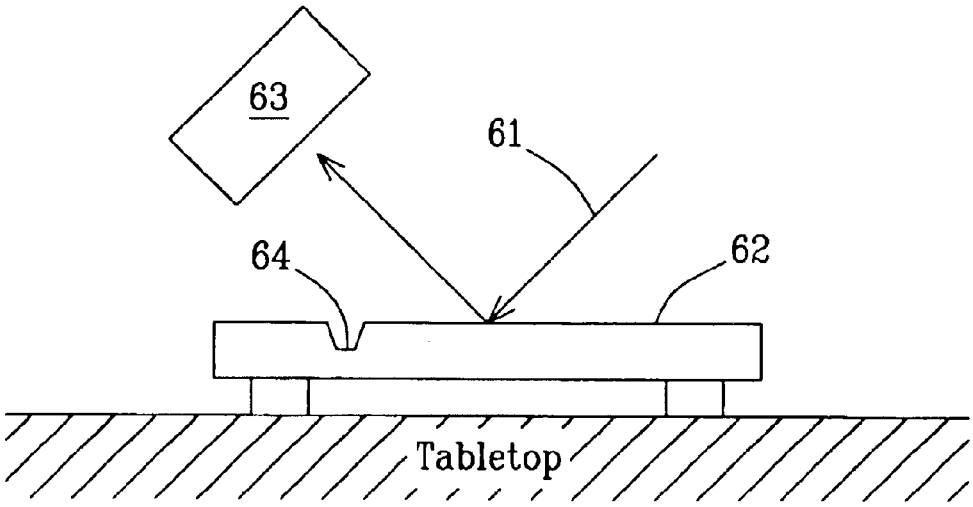
FIG. 6 is a diagram illustrating an optical surveying method using a laser.

One version of an optically-based method, referring to FIG. 6, includes reflecting a laser beam 61 off the surface of a workpiece 62 onto a segmented detector 63. As the laser rasters the surface 62 and encounters a surface defect 64, the position of the reflected laser spot shifts on the segmented detector 63. The laser scan and the coating may be repeated iteratively until the surface defect is substantially repaired, at which point the reflected laser spot would remain centered on the segmented detector 63. Furthermore, the laser survey may also be used to generate a model of the workpiece surface, which may be compared to a desired surface contour.

Figure 7:
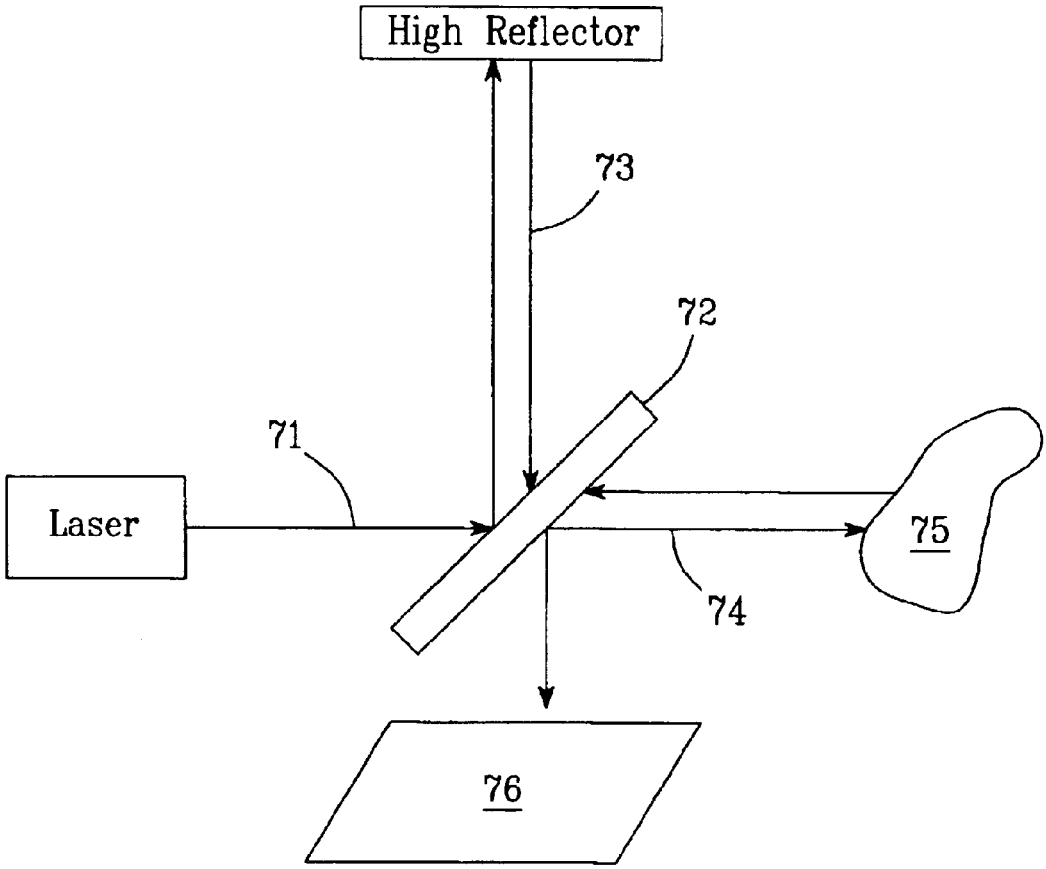
FIG. 7 is a diagram illustrating an optical surveying method using holographic interferometry.

Another version of an optically-based method involves holographic interferometry, as shown in FIG. 7. The laser beam 71 passes through a beam splitter 72, where one portion of the beam becomes a reference path 73 and the other portion becomes an information path 74 leading to the workpiece 75. After both the reference beam and the information beam reflect, they are combined and caused to interfere, thereby producing a pattern or image that may be captured on a screen or other imaging device 76.

While a preferred embodiment of the present invention has been shown and described, it will be apparent to those skilled in the art that many changes and modifications may be made without departing from the invention in its broader aspects. The appended claims, therefore, are intended to cover all such changes and modifications As they fall within the true spirit and scope of the invention.

We claim:

1. A method of controlling electrospark deposition, comprising the steps of:

a. providing a contact force to urge an electrode tip against a workpiece;

b. providing a series of electrical energy pulses to said electrode tip;

c. measuring a plurality of peak amplitudes from said series of electrical energy pulses;

d. determining a maximum peak value from said plurality of peak amplitudes;

e. comparing said maximum peak value to a target value, thereby obtaining an offset, wherein said target value correlates with an optimum contact force; and f. optimizing said contact force according to said offset.

2. The method as recited in claim 1, wherein said contact force may be imparted in any orientation.

3. The method as recited in claim 1, wherein said contact force is independent of gravity.

4. The method as recited in claim 1, wherein said workpiece is conductive.

5. The method as recited in claim 1, wherein said workpiece comprises a non-line-of-sight geometry.

6. The method as recited in claim 5, wherein said non-line-of-sight geometry is selected from the group consisting of an inner surface of a gun barrel, an inner surface of a valve body, a contoured surface, nuclear reactor and steam turbine components susceptible to wear and corrosion, surfaces on cutting components, and a surface of hydraulic cylinders and pistons.

7. The method as recited in claim 1, wherein said electrode tip and said workpiece are selected from the group consisting of alloys, ceramics, metals, and cermets.

8. The method as recited in claim 1, wherein said measuring step occurs at a rate of at least about one million times per second.

9. The method as recited in claim 1, wherein said measuring step occurs at a rate of about ten million times per second.

10. The method as recited in claim 1, wherein step c is measuring voltage, current, or power.

11. The method as recited in claim 1, wherein said plurality of peak amplitudes comprises a sampling of the last five amplitude measurements from said series of electrical energy pulses.

12. The method as recited in claim 1, wherein step f is dictated by control terms selected from the group consisting of proportional, integral, derivative and combinations thereof.

13. The method as recited in claim 1, wherein steps b–f are automated.

14. The method as recited in claim 13, wherein steps b–f are actuated by software-controlled electronic and mechanical components.

15. The method as recited in claim 1, wherein step f is manually actuated in response to a sensory stimulus emitted according to said offset between said maximum peak value and said target value.

16. The method as recited in claim 15, wherein said sensory stimulus is an audible tone, a visual display, a tactile sensation, or a combination thereof.

17. A method for electrospark deposition comprising the steps of:

a. providing an electrode tip, a workpiece having a surface, a contact force urging said electrode tip against said workpiece, and a series of electrical energy pulses to said electrode tip;

b. measuring a plurality of peak amplitudes from said series of pulses;

c. determining a maximum peak value from said plurality of peak amplitudes;

d. comparing said maximum peak value to a target value, thereby obtaining an offset wherein said target value correlates with an optimum contact force;

e. adjusting said contact force consistent with said offset, thereby achieving said optimum contact force between said electrode tip and said workpiece; and f. rastering said electrode tip across said surface of said workpiece, thereby metallurgically bonding a coating on said surface of said workpiece and creating a newly-coated workpiece.

18. The method as recited in claim 17, wherein said series of electrical energy pulses comprises a pulse frequency from about 100 to 5000 Hz.

19. The method as recited in claim 17, wherein said series of electrical energy pulses comprises a pulse frequency from about 500 to 1500 Hz.

20. The method as recited in claim 17, wherein said contact force comprises a force from about 0.75 to 1 Newton.

21. The method as recited in claim 17, wherein at least 1 degree of motion exists between said electrode tip and said workpiece.

22. The method as recited in claim 17, wherein three degrees of linear motion and three degrees of rotational motion exist between said electrode tip and said workpiece.

23. The method as recited in claim 17, wherein step f further comprises filling a flawed area on a surface of said workpiece.

24. The method as recited in claim 23, wherein said flawed area is a pit, groove, crack, worn section, corroded section, nick, chip, or a combination thereof.

25. The method as recited in claim 17, further comprising the step of using a design of experiments package to define optimal set points for a plurality of process parameters.

26. The method as recited in claim 25, wherein said design of experiments package comprises a Taguchi Variable mathematics package.

27. The method as recited in claim 25, wherein said plurality of process parameters is selected from the group consisting of electrode tip, process environment, workpiece, electrical variables, and combinations thereof.

28. The method as recited in claim 27, wherein said electrode tip variables are composition, microstructure, geometry, rotation speed, scan speed, contact force, number of passes, overlap of passes, or combinations thereof.

29. The method as recited in claim 27, wherein said process environment variables are cover gas composition, gas flow rate, temperature, geometry of flow, or combinations thereof.

30. The method as recited in claim 27, wherein said workpiece variables are material composition, cleanliness, surface finish, temperature, geometry, or combinations thereof.

31. The method as recited in claim 27, wherein said electrical variables are spark energy, spark frequency, voltage, capacitance, inductance, spark duration, sparking time per unit area, peak current, rise time, or combinations thereof.

32. The method as recited in claim 17, wherein said contact force is applied independent of gravity, orientation, or combinations thereof.

33. The method as recited in claim 17, further comprising the steps of:

a. surveying said surface of said workpiece after step a;

b. generating a measured three-dimensional model of said surface;

c. comparing said measured three-dimensional model to a theoretical three-dimensional model of a desired surface contour;

d. updating said measured three-dimensional model, after said rastering step, by surveying said newly-coated workpiece, thereby generating an updated version of said measured three-dimensional model; and e. repeating said comparing and said updating steps using said updated version as said measured three-dimensional model until said updated version is substantially the same as said theoretical three-dimensional model, thereby forming said desired surface contour on said workpiece.

34. The method as recited in claim 33, wherein said surveying step comprises using optically-based techniques.

35. The method as recited in claim 34, wherein said optically-based techniques are selected from the group consisting of laser surveying, holography, and microscopy.

36. The method as recited in claim 33, wherein said surveying step comprises using magnetically-based techniques.

37. The method as recited in claim 36, wherein said magnetically-based technique comprises eddy-current measurements.

38. The method as recited in claim 33, wherein said surveying step comprises using mechanically-based techniques.

39. The method as recited in claim 38, wherein said mechanically-based techniques are selected from the group consisting of surface probe measurements and profilometry.

40. The method as recited in claim 33, wherein said workpiece comprises a flawed component.

41. The method as recited in claim 33, wherein said theoretical three-dimensional model comprises an unflawed specification of a flawed workpiece.

42. An apparatus for electrospark deposition comprising:

a. an electrical-energy wave generator;

b. an electrical signal sensor;

c. an electrode tip electrically connected to said electrical-energy wave generator and said electrical signal sensor;

d. a high-speed data acquisition card electrically connected to said electrical signal sensor;

e. a mounting system for maintaining a workpiece in operable communication with said electrode tip;

f. an actuator providing a contact force and a relative motion between said workpiece and said electrode tip;

g. a processor electrically connected to said high-speed data acquisition card and to said actuator, wherein said processor receives a data input, compares said data input to a set point, and transmits a drive signal to said actuator, thereby altering a contact force.

43. The apparatus as recited in claim 42, wherein said high-speed data acquisition card acquires data at a rate of at least about one million times per second.

44. The apparatus as recited in claim 42, wherein said high-speed data acquisition card acquires data at a rate of about ten million times per second.

45. The apparatus as recited in claim 42, wherein said electrical signal sensor is an ammeter, a voltmeter, or a power meter.

46. The apparatus as recited in claim 42, further comprising a housing attached to said electrode tip, whereby said housing allows an operator to manually manipulate said electrode tip.

47. The apparatus as recited in claim 46, wherein said housing comprises a handle.

48. An apparatus as recited in claim 42, further comprising an indicator electrically connected to said processor, wherein said processor optionally transmits a drive signal to said indicator resulting in the emission of a sensory stimulus correlating with said contact force.

49. The apparatus as recited in claim 48, wherein said sensory stimulus is an audible tone, a visual display, a tactile sensation, or a combination thereof.

50. The apparatus as recited in claim 42, wherein said electrode tip comprises a non-axial configuration.

51. The apparatus as recited in claim 50, wherein said non-axial configuration comprises a disc.

52. The apparatus as recited in claim 51, wherein said disc is spinning.

53. The apparatus as recited in claim 50, wherein said non-axial configuration comprises a bent tip.

54. The apparatus as recited in claim 53, wherein said bent tip is oscillating.

* * * * *